United States Patent [19]

Alvemarker

[11] Patent Number: 4,653,520

[45] Date of Patent: Mar. 31, 1987

[54] DISHWASHER FOR LARGE ARTICLES

[76] Inventor: Arne Alvemarker, Malaregatan 3, S-240 21 Löddeköpinge, Sweden

[21] Appl. No.: 637,228

[22] PCT Filed: Nov. 28, 1983

[86] PCT No.: PCT/SE83/00414

§ 371 Date: Jul. 26, 1984

§ 102(e) Date: Jul. 26, 1984

[87] PCT Pub. No.: WO84/02068

PCT Pub. Date: Jun. 7, 1984

[30] Foreign Application Priority Data

Nov. 26, 1982 [SE] Sweden ..... 8206735
May 18, 1983 [SE] Sweden ..... 8302800

[51] Int. Cl.[4] ..... B08B 3/02

[52] U.S. Cl. ..... 134/157; 134/148; 134/110; 49/41; 312/238; 210/407

[58] Field of Search ..... 134/109, 110, 115 R, 134/137, 148, 157, 158; 422/26, 297, 300; 49/41; 312/238, 326, 138 A; 210/407, 420, 424

[56] References Cited

U.S. PATENT DOCUMENTS

| | | | |
|---|---|---|---|
| 745,574 | 12/1903 | Craig | 312/326 X |
| 874,933 | 12/1907 | Bristow, Jr. | 312/238 X |
| 2,555,725 | 6/1951 | Archbold | 210/407 X |
| 2,621,505 | 12/1952 | Smith | 134/110 X |
| 2,745,260 | 5/1956 | Saunders | 312/138 A X |
| 3,027,010 | 3/1962 | Dreisbach | 210/429 X |
| 3,101,227 | 8/1963 | Pugh | 312/326 X |
| 3,188,159 | 6/1965 | Wenger et al. | 312/326 X |
| 3,951,684 | 4/1976 | LaPrad et al. | 134/148 X |
| 4,179,307 | 12/1979 | Cau et al. | 134/148 X |

*Primary Examiner*—Harvey C. Hornsby
*Assistant Examiner*—Frankie L. Stinson
*Attorney, Agent, or Firm*—Young & Thompson

[57] ABSTRACT

A dishwasher for large articles, comprising a washing chamber and a door in a door opening to the washing chamber of the dishwasher with spray nozzles arranged therein in vertical rows of vertically spaced nozzles for dishwater, characterized in that the door when closed is supported by at least one pivot arm which is mounted to pivot about a vertical axis located inside and centrally of the washing chamber at a position such that the door can be swung laterally from its closed position and into the washing chamber as well as to a position at its rear wall directly opposite the opening, the upper and lower edges of the door diverging in the direction in which the door moves when swing from the closed position, the upper and lower edges of the door opening divering in the same manner to receive the door when returned to its closed position, there being an upper and a lower pivot arm at the upper and lower edge, respectively, of the door, and at least one washing article carrier mounted on the inside of the door.

5 Claims, 14 Drawing Figures

DISHWASHER FOR LARGE ARTICLES

The present invention relates to a dishwasher for large articles.

The invention is primarily intended to achieve a dishwasher of intermediate size which constitutes an improvement over the dishwasher disclosed in U.S. Pat. No. 4,374,443 and also over certain other known dishwashers of intermediate size, in which a door is folded down and a washing article carrier is pulled out like a basket.

Heavy dishwashers are often used for washing relatively heavy vessels which must be lifted into and out of the carrier or rack. It is in itself relatively heavy work to push a car with a washing article carrier or a carrier in the form of a sliding basket filled with heavy articles to be washed, and if the carrier or rack is also at too high a level, lifting heavy mixing vessels and pots for example into and out can produce overexertion. In addition to this heavy lifting, one may have to bend over the carrier in order to place the vessel in the right position or remove if from this position. The risk of injury is considerable.

The purpose of the present invention is therefore primarily to achieve an intermediate size dishwasher which makes it possible to reduce the amount of work required in washing articles.

According to the invention, the door can be swung about a vertical axis located inside the washing chamber of the dishwasher in such a position that the door, together with at least one dishrack or carrier can be swung to a position adjacent the rear wall of the washing chamber with the dishrack or carrier facing the door opening. Very little effort is required for this swinging movement if the door is correctly hung. It is also possible to swing the door so that the carrier is placed obliquely in either direction in the door opening so that it can be easily filled with articles to be washed from one side or the other of the dishrack or carrier; or when the rack faces straight at the door opening, heavy vessels and the like can be lifted to a special rack made according to the invention, the features of which are revealed in the subclaims. One of the supporting planes of the dishrack can be placed at a comfortable level to enable a heavy vessel to be transported and placed on the rack with practically no lifting involved. The dishrack or carrier according to the invention is also arranged for maximum utilization of the rack space to load it with various sizes of vessels e.g. 2/1, 1/1, $\frac{1}{2}$, $\frac{2}{3}$, $\frac{1}{3}$, $\frac{1}{4}$, 1/6 and 1/9 according to the Gastronorm system or corresponding national standard sizes.

The dishrack or carrier according to the invention can be used with advantage in dishwashers in which granules are mixed in the dishwasher to mechanically work the washing articles in combination with spraying of liquid from the size of the rack. In connection with such spraying, the invention proposes a new separation device as revealed in the accompanying subclaims for separating granules from the liquid. In the final phase of washing, it is desirable to spray liquid without granules to rinse the articles free of granules, and for this the separation device is set for separating out granules. The new separation device according to the invention eliminates the risk of granules clogging the separation means such as a straining cloth, a perforated or slotted plate by virtue of the fact that the liquid with granules is drawn up against the underside of the straining cloth, and granules with a larger specific weight than the liquid will, due to their own weight, tend to sink down against the effect of the flow forces.

These and other characteristic features and advantages of the invention will be explained in more detail with reference to an embodiment shown in the accompanying drawings of a dishwasher according to the invention with the various new features.

Figure 1:
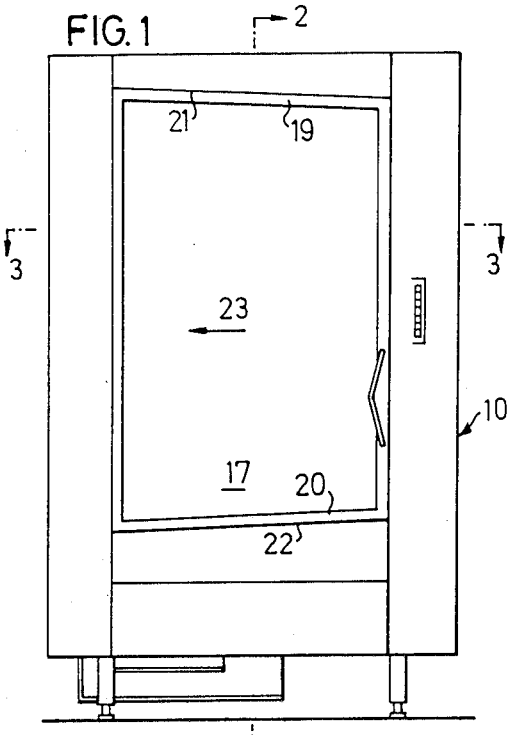
FIG. 1 is a front elevation of a dishwasher according to the invention with a swinging door.
Figure 2:
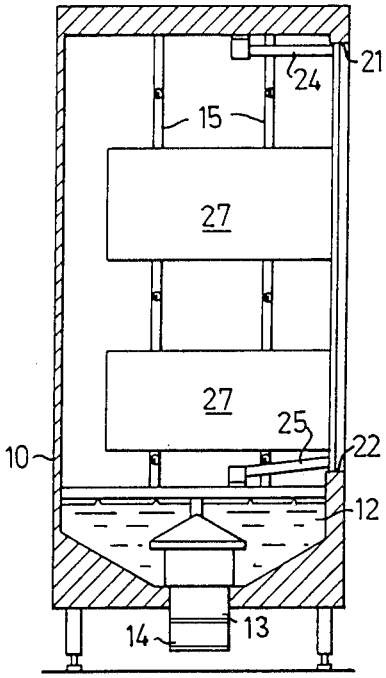
FIG. 2 is a secton along the line 2—2 in FIG. 1.
Figure 3:
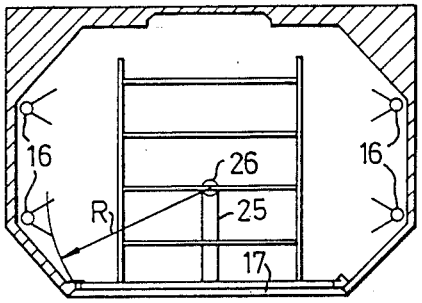
FIG. 3 is a cross section along the line 3—3 in FIG. 1 with the door closed.

The dishwasher shown in FIGS. 1–5 consists of a housing 10 with a washing chamber 11 located therein and a liquid tank 12 at the lower end with a drain 13 to a suction conduit 14 to a pump (not shown), which pumps liquid such as water or washing liquid to a number of spray nozzles 15 which are disposed along four vertical pipes 16 arranged at the four corners of the washing chamber. The pipes oscillate to disperse the spray. The various dishwasher phases are controlled by an electronic control system.

The front of the housing has a door 17 with a door opening 18. Both the upper and lower edges 19,20 of the door and the upper and lower edges 21,22 of the door opening diverge in one direction (arrow 23), which is also the opening direction of the door.

Figure 5:
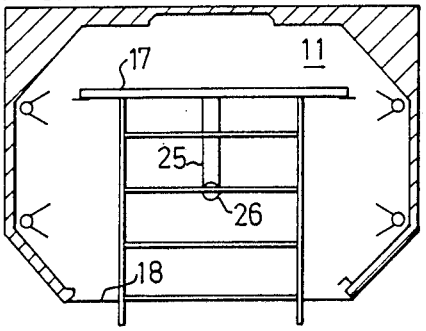
FIG. 5 shows the door in its inner end position at the rear wall in the treatment chamber and with the free ends of the racks sticking outside the door opening to facilitate loading and unloading of articles to be washed.
Figure 7:
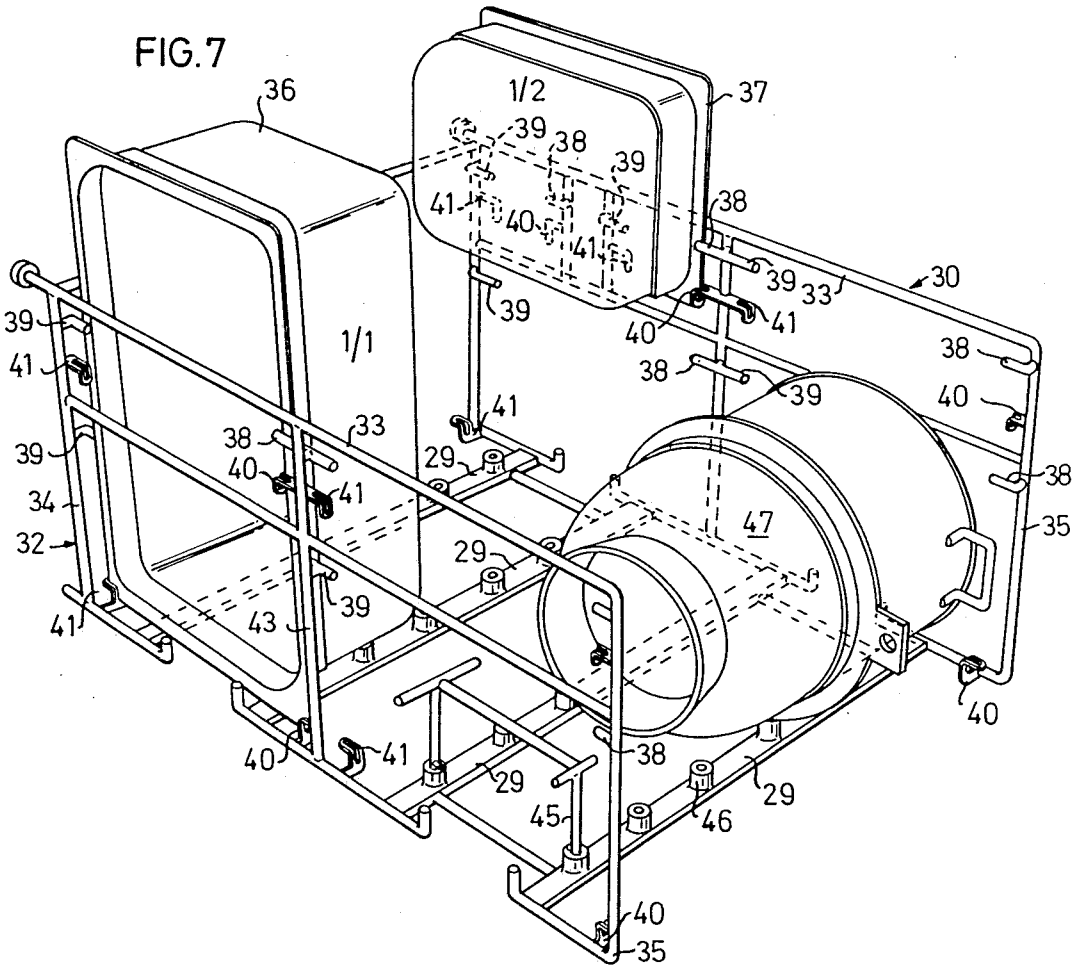
FIG. 7 shows a schematic perspective view of a suitable dishrack or carrier for the dishwasher in FIGS. 1–6.

The door is carried by an upper and a lower pivot arm 24,25 which are mounted to pivot about a vertical axis 26 disposed inside the washing chamber so that the door can be swung in a path along the inside of the chamber to a rear position as shown in FIG. 5, the lateral edges of the door following a circle of radius R.

Figure 6:
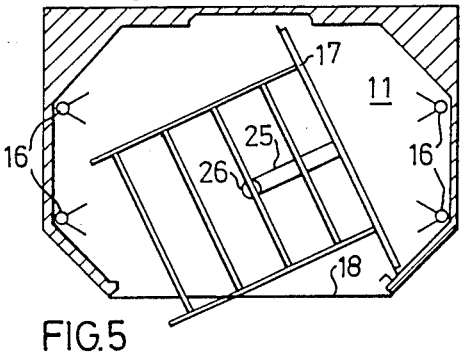
FIG. 6 shows an oblique position where the door has been swung past its 180° position in FIG. 5 by an additional 50° so that the dishrack or carrier is at an oblique angle in the opening to make the other side of the rack accessible.
Figure 4:
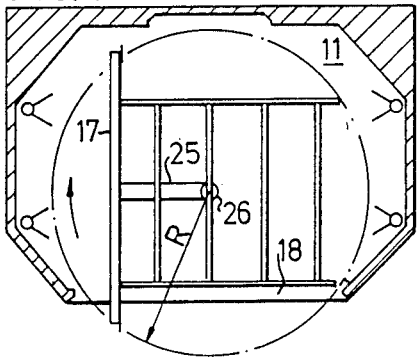
FIG. 4 shows the door together with the dishracks swung to an intermediate position where one side of the dishracks is easily accessible.

At least one washing article carrier or rack is mounted on the inside of the door (in the example shown a lower and an upper rack 26,27) preferably of the design shown in FIGS. 7–11. When the door is in the rear position, the rectangular racks project out through the opening 18 as shown in FIG. 5 to permit easy loading of heavy vessels on the lower rack. The racks can be swung to an oblique position in the opening in one direction as shown in FIG. 6. In this oblique position there is easy access to the rack from one side, and the other side becomes easily accessible in the position shown in FIG. 4. The racks or carriers lie within the circle of radius R.

By virtue of the fact that the upper and lower edges of the door, as well as the upper and lower edges of the door opening diverge in the direction 23 in which the door is swung to the side from its closed position, a good seal is obtained when the door is swung back to its closed position. With the mounting described, very little force is required to swing the door with loaded racks by hand to comfortable working positions for unloading and loading of the racks.

In order to exploit the advantages of the swinging door according to the invention and the rack(s) or carrier(s) mounted thereon, a rack or carrier 28 of the type shown in FIGS. 7–11 can be used with advantage. It consists of four transverse bars 29 forming the supporting surface or bottom which is fixed between two side walls 30,32. Each side wall consists of a frame with an upper frame member 33 and two side members 34,35. In order to slide in vessels 36,37 from the side, there are a number of slide supports in the form of cylindrical pins 38,39 directed towards each other in pairs, on which the vessels can slide on their edge flanges A when being slid in and swung up to a vertical position on the inside of the respective side wall. The vessel is then lowered so that its lower edge flange will rest in an opposing pair of corner supports 40,41. The slide supports will prevent the vessels from falling backwards because the edge flanges will be stopped by the slide supports, and the upper frame member and an intermediate horizontal bar 42 will prevent the vessels from falling forward.

As shown in the figures, there are corner supports 40,41 at the lower ends of the side members 34,35 and corner supports 40,41 on either side of the lower end of a vertical center bar 43. Corresponding corner supports 40,41 are to be found at a level above the slide supports 38,39 as shown in the drawings.

The arrangement of the corner supports and slide supports is such that all existing sizes of vessels in the Gastronorm system can be placed and held in washing position on the side walls as illustrated in FIGS. 8–11.

Figure 8:
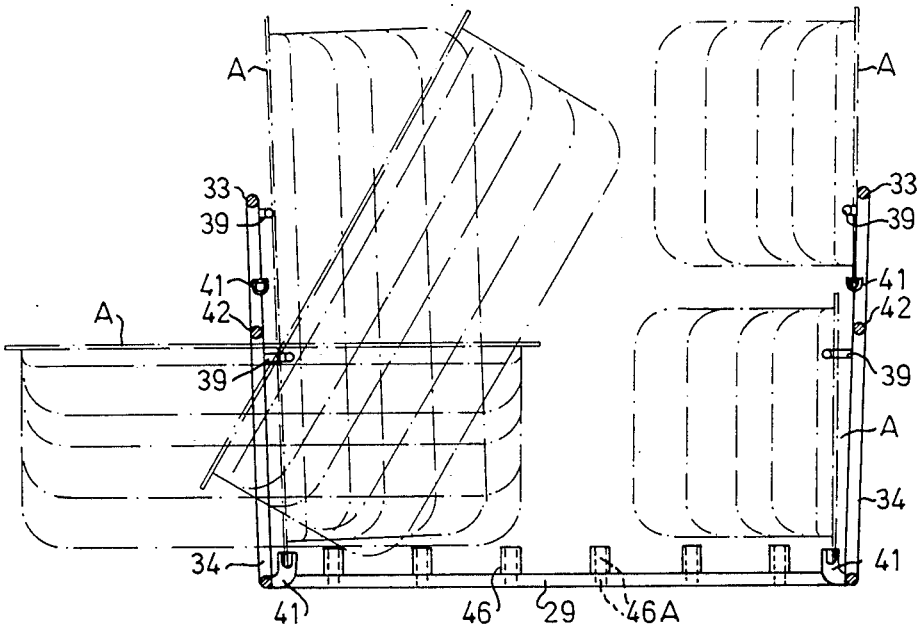
FIG. 8 is a schematic cross section through the carrier and illustrates how vessels of various sizes can be easily slid in through the side walls of the carrier on special slide supports and thereafter be swung up to an intermediate position and a final vertical position along the inside of the side wall; the other side wall carries two smaller vessels, one on top of the other.
Figure 9:
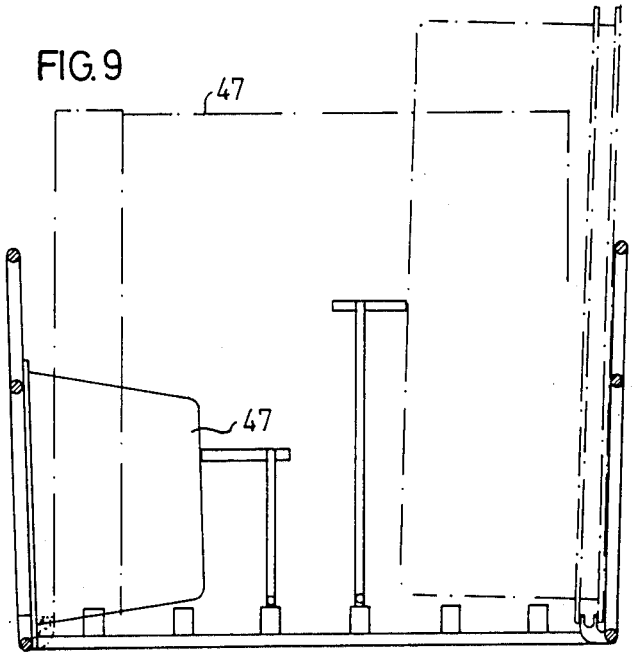
FIG. 9 illustrates how plastic trays with a guiding U-edge can be slid into the carrier and held in place by braces.
Figure 10:
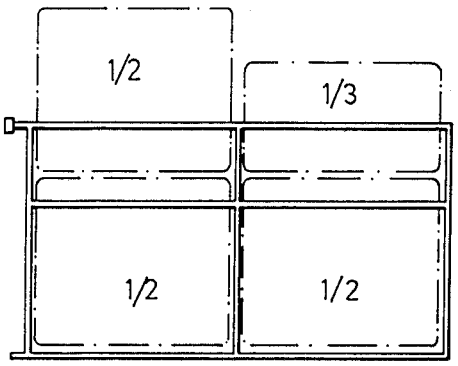
FIG. 10 shows how various sizes of vessels in the Gastronorm system can be arranged and held in place on the inside of one side wall with simple support means.
Figure 11:
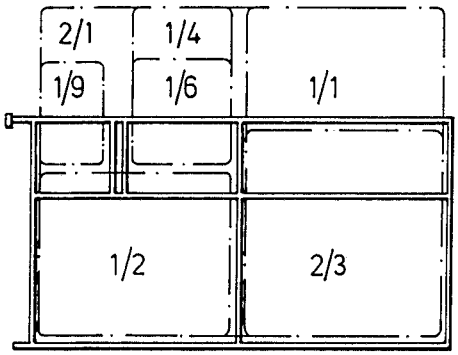
FIG. 11 is a corresponding view of the other side wall.

FIG. 8 illustrates how it is possible to slide in a vessel with the edge flanges sliding on a pair of slide supports, to swing the vessel up to the intermediate position shown and then to a vertical position, and to thereafter lower the vessel so that its lower edge flange engages the corner supports 40,41, with the vessel being held in position by the lower and upper slide supports 39. The dashdot lines indicate the various sizes of vessels which can be used.

The level of the slide supports 38,39 is such that if a vessel of size 1/1, ⅔, or ½–200 is slid in from the end of the carrier on the supporting feed 46 and is turned in between a pair of opposing lower slide supports 38,39, the edge flanges A of the vessel will slide up on the slide supports whereby the vessel can be pulled out somewhat on the slide supports and then be swung up to its vertical position and be lowered down onto the corner supports 40,41.

The length of the side walls is suitably about 700 mm so that two 1/1 vessels can be placed side by side along one side wall, or one 2/1 vessel can be placed along a side wall and be held by a brace.

It is possible to mount various types of braces 45 by virtue of the fact that supporting feet 46 are placed in successive rows in a module system and have through-holes 46A through the transverse bars to receive the ends of the braces and to prevent the collection of liquid in the holes.

The supporting feet 46 form points of contact for round vessels 47 which are lifted onto the supporting feet, and this point contact eliminates pockets which can collect dirt or granules if used, in contrast to the known placement directly on round bars providing a certain line contact and thus creating undesirable collection pockets. The supporting feet provide space for reinforcement rings etc on the article to be washed.

Figure 12:
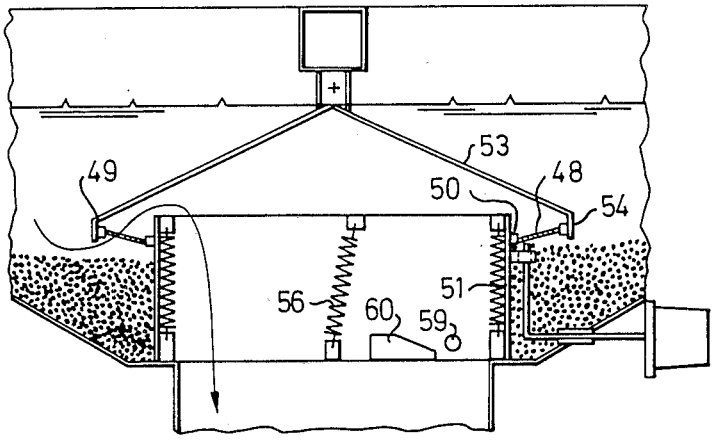
FIG. 12 is a schematic section through a bottom drain with a separating device for separating out granules from the dishwasher with the device set to separate out the granules.
Figure 14:
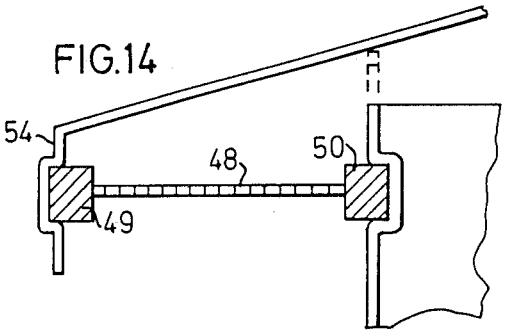
FIG. 14 is a detailed view of the mounting of the separating means.
Figure 13:
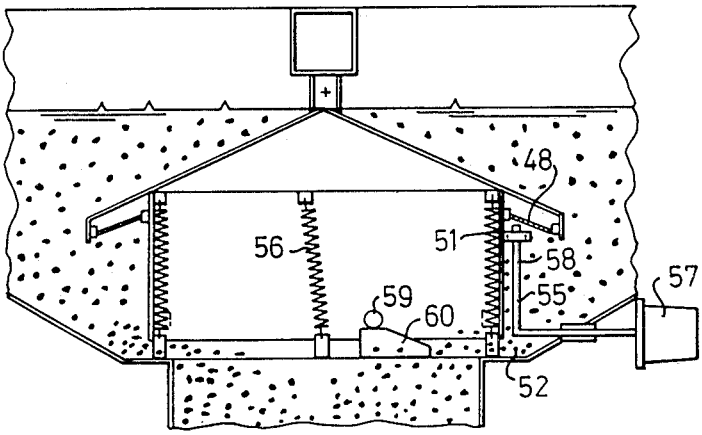
FIG. 13 shows a device set to allow the granules to pass out together with the liquid in a conduit to the dishwasher pump.

If washing is to be done with the aid of granules, it is advisable to use a bottom valve of the construction shown in FIGS. 12–14. This bottom valve forms a separation device which when in the position shown in FIG. 12 causes the granules to be stopped by their own weight when moving against the underside of a separating means in the form of an annular straining cloth 48 stretched between an outer ring 49 and an inner ring 50. The granules then fall down to a bottom tank about a vertically movable pipe or valve ring 51, which is in FIG. 12 in its lower end position closing a gap 52 at the lower end of the valve ring. At the upper end of the ring, liquid passes up through the straining cloth 48 and down through the ring to the pump conduit. A roof 53 is arranged on top of the valve ring and has a downwardly directed edge 54. The outer ring 49 is fixed on the inside of said edge in a groove, while the inner ring 50 is fixed in a groove at the upper end of the valve ring 51. This mounting of the straining cloth prevents granules from lodging in a gap between these parts which are movable relative to each other, thus reducing the need for maintenance and assuring reliability of operation.

When the valve ring is lifted with the aid of a servo control lifting device 55 to its upper position, the flow through the straining cloth is completely or partially cut off and the liquid with granules flows freely out through the lower gap 52 directly into the pump conduit as shown in FIG. 13.

The ring 51 is loaded by tension springs 56 which keep the ring in contact with the bottom of the tank in the position shown in FIG. 12. An electric motor 57 turns an arm 58 in either direction. From the position shown in FIG. 12, the ring 51 is rotated so that the pin 59 on the ring rides up on a cam 60 thus lifting the ring to the position shown in FIG. 13. Rotating the ring in the opposite direction causes the ring to be lowered to the position shown in FIG. 12.

If the separating means is a perforated plate or the like, its inner edge will be slidably disposed about the valve ring so that the ring can slide up and down relative to the annular separating means. The outer edge of the ring is fixed to the roof 53.

I claim:

1. Dishwasher for large articles, comprising a washing chamber and a door in a door opening to the washing chamber of the dishwasher with spray nozzles arranged therein in vertical rows of vertically spaced nozzles for dishwater, characterized in that the door when closed is supported by at least one pivot arm which is mounted to pivot about a vertical axis located inside and centrally of the washing chamber at a position such that the door can be swung laterally from its closed position and into the washing chamber as well as to a position at its rear wall directly opposite the opening, the upper and lower edges of the door diverging in the direction in which the door moves when swung from the closed position, the upper and lower edges of the door opening diverging in the same manner to receive the door when returned to its closed position, there being an upper and a lower said pivot arm at the upper and lower edge, respectively, of the door, and at least one washing article carrier mounted on the inside of the door.

2. Dishwasher according to claim 1, characterized in that the door can be swung through about 230° from its closed position so that the door will go somewhat past its rear position, placing the washing article carrier somewhat obliquely in the door opening.

3. Dishwasher according to claim 1, characterized in that the washing article carrier is rectangular in shape as viewed from above, and that its free end is positioned so that it will be somewhat outside the door opening when the door is swung to its rear position.

4. Dishwasher having a separation device for separating granules from dishwater, said separator including a valve means which in one position releases granules and dishwater directly into a pump conduit and in a second position forces the dishwater with granules against a separation means so that the granules are separated out and the dishwater passes without the granules on to the pump conduit, said separation means comprising a valve ring with a vertical central axis movable between a lower position in which the lower end of the ring closes off a discharge gap for liquid and granules and opens a gap between the upper end of the ring and a roof above the ring, and an upper position in which the lower end of the ring opens said discharge gap for dishwater and granules, said separation means comprising a strainer of annular configuration that surrounds the ring and bridges the gap between the ring and the roof when the ring is in said lower position, said strainer having an inlet side on which the strainer receives oncoming dishwater and granules, said inlet side facing downward, whereby granules fall by gravity from said inlet side of said strainer.

5. A device as claimed in claim 4, in which said strainer comprises a straining cloth stretched between an inner ring secured to the valve ring and an outer ring secured to the roof.

* * * * *